US006032962A

United States Patent [19]

DiGregorio

[11] Patent Number: 6,032,962

[45] Date of Patent: Mar. 7, 2000

[54] ISOBLADER SKATES

[76] Inventor: Vito DiGregorio, 119 Arthur Ave., Staten Island, N.Y. 10305

[21] Appl. No.: 09/360,175

[22] Filed: Jul. 23, 1999

[51] Int. Cl.[7] ..... A63C 3/00

[52] U.S. Cl. ..... 280/8; 280/8; 280/11.12; 280/11.22

[58] Field of Search ..... 280/7.1, 7.12, 280/7.13, 7.14, 8, 9, 10, 11, 11.12, 11.22, 11.27, 11.23, 11.28

[56] References Cited

U.S. PATENT DOCUMENTS 1,501,271 7/1924 Colson ..... 280/8
3,552,746 1/1971 Nagin ..... 272/3
3,689,091 9/1972 Nagin ..... 280/11.12
5,911,422 6/1999 Carpenter et al. ..... 280/10

*Primary Examiner*—Richard M. Camby
*Attorney, Agent, or Firm*—J. Sanchelima

[57] ABSTRACT

A skate assembly that includes a rigid runner plate mounted perpendicularly to the underside of a boot. The runner includes one or more cutouts where wheel or roller assemblies are rotatably mounted. The roller assemblies lowermost tangential edge is aligned with the bottom edge of the runner. The roller members for the respective roller assemblies include serrations on their periphery. The result being to lower the overall friction of the edge by reducing the effective contact area of the edge with the skating surface by introducing the cut-outs with roller members providing a support point in the middle of the cut-out.

3 Claims, 1 Drawing Sheet

ISOBLADER SKATES

BACKGROUND OF THE INVENTION

1. Field of the Invention

The present invention relates to skates, and more particularly, to skates with stainless steel blades and wheels substantially aligned with the blades.

2. Description of the Related Art

Applicant believes that the closest reference corresponds to U.S. Pat. No. 3,552,746 issued to Nagin (1971). However, it differs from the present invention because Nagin's invention is designated to be used on a resin surface as training for skating on an ice surface. Also, the wheels are not aligned with the blade but rather designed to provide lateral stability and forward thrust. The patentee states that the rollers do not detract from the forward glide. The present invention is not concerned with lateral stabilization or braking, to provide forward thrust. Instead, it minimizes the forward friction by having rollers occupy (replace) a substantial portion of the blade.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a skate with minimum friction to enhance the forward glide.

It is another object of this invention to provide a skate that is light in weight and uses a minimum of parts.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
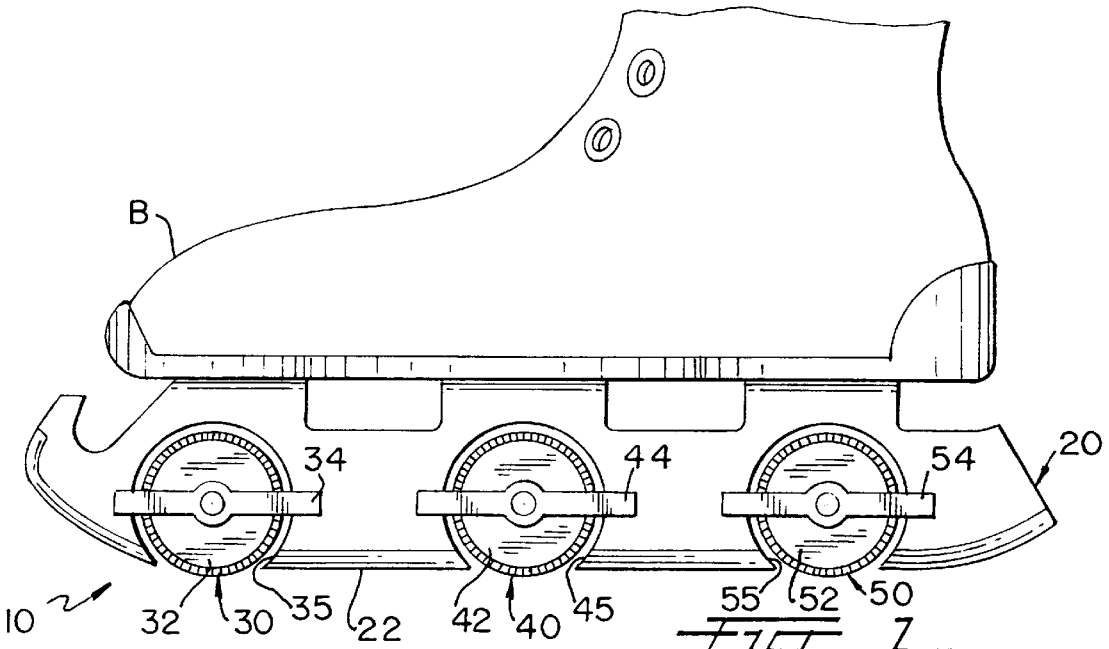
FIG. 1 represents an elevational view showing one of the preferred embodiments for the present invention.
Figure 2:
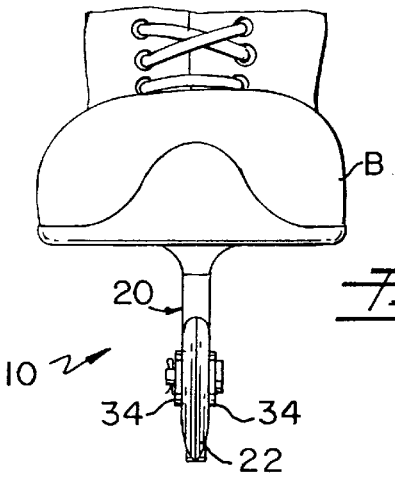
FIG. 2 shows a front view of the isoblader skate.
Figure 3:
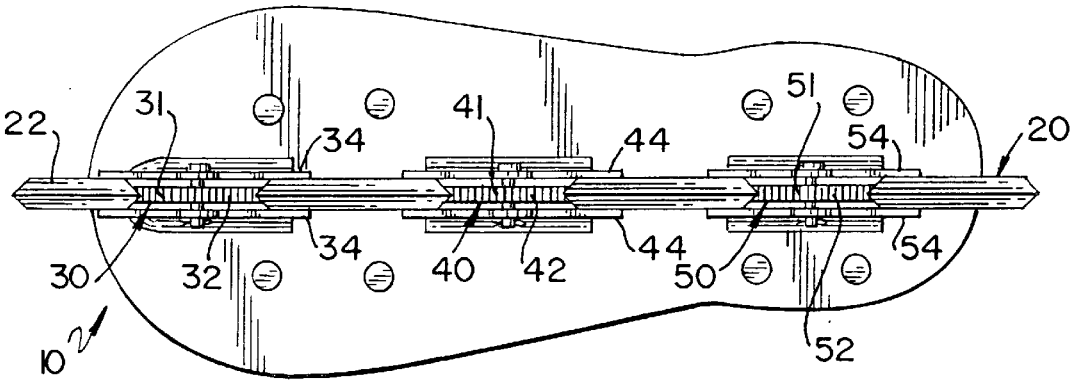
FIG. 3 illustrates a bottom view of the present invention.

Referring now to the drawings, where the present invention is generally referred to with numeral 10, it can be observed that it basically includes a runner 20 that is basically a rigid plate that extends along the entire length of boot B and, is one of the preferred embodiments, three roller or wheel assemblies 30; 40; and 50 mounted so that the lowermost ends are tangentially aligned with each other and lower edge 22 of runner 20. Edge 22 is interrupted where assemblies 30; 40 and 50 are mounted, thereby replacing the respective edge portions with bays or cut-outs 35; 45 and 55 with a lower frictional coefficient attributed to roller assemblies 30; 40 and 50.

Roller assemblies 30; 40; and 50 include roller elements 32; 42; and 52 rotatably mounted to support brackets 34; 44; and 54. Roller elements are preferably made out of steel with peripheral serrations or fine threads 31; 41; and 51 to enhance gripping action. The friction showed by elements 32; 42; and 52 is lower than it would be otherwise if edge 22 were continuous.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A skate assembly, comprising:

A) a runner mounted to the underside of a boot and extending longitudinally defining a substantially straight lower edge extending parallel and at a spaced apart relationship with respect to said underside with at least one cutout; and B) at least one roller assembly rotatably mounted within said cutout and said roller assembly having a roller member with a lowermost end tangentially aligned and in the same vertical plane with said lower edge.

2. The skate assembly set forth in claim 1 wherein said roller members includes a plurality of serrations running parallel to the rotation axis of said roller members.

3. The skate assembly set forth in claim 2 wherein each of said roller assemblies include ball bearing means for rotably supporting said roller members.

* * * * *